US010101043B2

(12) United States Patent
Bellamy, Jr.

(10) Patent No.: US 10,101,043 B2
(45) Date of Patent: Oct. 16, 2018

(54) HVAC SYSTEM AND METHOD OF OPERATION

(71) Applicant: Specialty Air Solutions and Design, Inc., Palatka, FL (US)

(72) Inventor: James E. Bellamy, Jr., Palatka, FL (US)

(73) Assignee: Energy Design Technology & Solutions, Inc., Palatka, FL (US)

( * ) Notice: Subject to any disclaimer, the term of this patent is extended or adjusted under 35 U.S.C. 154(b) by 527 days.

(21) Appl. No.: 14/184,350

(22) Filed: Feb. 19, 2014

(65) Prior Publication Data

US 2015/0027156 A1 Jan. 29, 2015

Related U.S. Application Data

(60) Provisional application No. 61/859,032, filed on Jul. 26, 2013.

(51) Int. Cl.

| | |
|---|---|
| ***F25B 27/00*** | (2006.01) |
| ***F24F 5/00*** | (2006.01) |
| ***F25B 25/00*** | (2006.01) |

(52) U.S. Cl.

CPC ..... *F24F 5/0035* (2013.01); *F25B 25/005* (2013.01); *Y10T 29/49352* (2015.01)

(58) Field of Classification Search

CPC ..... F24F 5/0035; F24F 5/001; F24F 5/0003; F25B 40/02; F25B 2400/05; F25B 2313/06

See application file for complete search history.

(56) References Cited

U.S. PATENT DOCUMENTS

| | | | | |
|---|---|---|---|---|
| 4,869,069 | A | 9/1989 | Scherer | |
| 4,893,476 | A | 1/1990 | Bos et al. | |
| 4,995,241 | A | 2/1991 | Vandervaart | |
| 5,263,892 | A | 11/1993 | Vandervaart | |
| 5,361,601 | A | 11/1994 | Han et al. | |
| 5,671,607 | A * | 9/1997 | Clemens | F04B 37/18 62/114 |
| 5,906,104 | A | 5/1999 | Schwartz et al. | |
| 6,233,957 | B1 | 5/2001 | Hirao et al. | |
| 6,253,564 | B1 | 7/2001 | Yarbrough et al. | |
| 6,640,889 | B1 | 11/2003 | Harte et al. | |
| 6,662,864 | B2 | 12/2003 | Burk et al. | |
| 6,691,526 | B2 | 2/2004 | Gether et al. | |
| 6,705,112 | B1 | 3/2004 | Kadle et al. | |

(Continued)

OTHER PUBLICATIONS

Zhang, M., "Energy Analysis of Various Supermarket Refrigeration Systems", International Refrigeration and Air Conditioning Conference, Purdue University, IN, http://docs.lib.purdue.edu/iracc/856, (Jul. 17-20, 2006).

*Primary Examiner* — Elizabeth Martin
(74) *Attorney, Agent, or Firm* — McHale & Slavin, P.A.

(57) ABSTRACT

An improved, energy-efficient HVAC system and method of use employing a solution that is run parallel to refrigerant lines in a chiller unit. The solution is directed through the chiller unit through its proximity to chilled refrigerant wherein the chilled solution, rather than refrigerant, enters an air handler or an air pump and used to adjust the air temperature to a desired level. The system and method permits the place of a refrigerant based system external an enclosed building and a non refrigerant based system position internal the enclosed building.

7 Claims, 5 Drawing Sheets

(56) References Cited

U.S. PATENT DOCUMENTS

| | | | | |
|---|---|---|---|---|
| 6,769,481 | B2 | 8/2004 | Yoshimura et al. | |
| 7,155,922 | B2 | 1/2007 | Harmon et al. | |
| 7,174,735 | B2 | 2/2007 | Satoh et al. | |
| 7,296,426 | B2 | 11/2007 | Butler et al. | |
| 7,380,588 | B2 | 6/2008 | Helt | |
| 7,407,002 | B2 | 8/2008 | Jang et al. | |
| 7,520,320 | B2 | 4/2009 | Itoh et al. | |
| 7,530,390 | B2 | 5/2009 | Feuerecker et al. | |
| 7,716,934 | B2 | 5/2010 | Ebara | |
| 7,757,508 | B2 | 7/2010 | Ally et al. | |
| 8,082,749 | B2 | 12/2011 | Sekine et al. | |
| 8,220,531 | B2 | 7/2012 | Murakami et al. | |
| 8,397,799 | B2 | 3/2013 | Blecker | |
| 8,470,071 | B2 | 6/2013 | Ehrenberg et al. | |
| 8,487,580 | B2 | 7/2013 | Woodward | |
| 8,539,789 | B2 | 9/2013 | Kopko et al. | |
| 2008/0315152 | A1* | 12/2008 | Daly | C09K 5/10 252/73 |
| 2012/0291468 | A1* | 11/2012 | Kato | F24F 3/06 62/185 |
| 2013/0091891 | A1* | 4/2013 | Hinde | F25B 43/02 62/470 |

* cited by examiner

| | |
|---|---|
| Case Findings - 1<br><br>Electrical demand was reduced by 37%.<br><br>Primary driver: Hardware - Software. |  |

Case Findings - 2

Electrical consumption increased due to increased utilization of facilities.

Primary driver: People

| | |
|---|---|
| Case Findings - 3<br><br>Cost during the study period trended down.<br><br>Primary driver: Hardware - Software |  |

HVAC SYSTEM AND METHOD OF OPERATION

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/859,032, entitled HVAC SYSTEM AND METHOD OF OPERATION, filed on Jul. 26, 2013, the contents of which is incorporated herein by reference.

FIELD OF THE INVENTION

The present invention relates to the field of HVAC systems and in particular to an energy efficient HVAC system and method of use employing a chilled solution rather than refrigerant for temperature adjustment.

BACKGROUND OF THE INVENTION

HVAC (heating, ventilation, and air conditioning) systems are used extensively to regulate the environment within an enclosed space, most commonly within residential and commercial buildings. HVAC systems are relied upon to help maintain good indoor air quality through adequate ventilation with filtration and provide temperature regulation to maintain comfort within the building. Typically an air blower pulls air from inside the building into the HVAC system through ducts. Air in the HVAC system is then conditioned (e.g., heated, cooled, or dehumidified) before being recirculated back into the building. HVAC systems are also designed to exchange and replenish the circulated air inside the building with fresh air from outside the building. The exchanged air needs to be conditioned to match the desired environment inside of the building before being circulated throughout the building.

Because HVAC systems are so ubiquitous and usually are in continuous operation in many buildings, a great amount of energy is dedicated to the operation of HVAC systems. Individual businesses and industrial users of electrical power bear the cost of this energy consumption and are charged not only for the usage of energy (kWh) but also for the maximum energy demand (kWd) they require at any given time. Typically, a demand-measuring meter constantly tracks and records the highest 30 minute average level of energy demand (kWd) during each monthly billing period, resulting in demand charges added to each monthly bill. HVAC systems can be responsible for a high percentage of demand charges.

Accordingly, improvements which can accomplish conservation of energy in the operation of HVAC systems are continually being sought. Even the conservation of relatively small amounts of energy in the operation of a single HVAC system can be significant when viewed in the light of the multitude of HVAC systems in use.

Existing air to air systems generally have three main components and utilize Freon throughout the system. The three primary components of the air to air system are the condenser (Compressor and coil), the Evaporator fan and coil (Air handler) and the pressurized piping for transmission to and from each of these components. These systems are closed loop Freon systems with the Refrigerant pipes going into the conditioned space and returning to the compressor outside.

The present invention provides an improved, energy efficient HVAC system without a need for extensive electrical connections to the existing HVAC system and methods of use thereof.

DESCRIPTION OF THE PRIOR ART

U.S. Pat. No. 8,487,580 discloses a blower motor assembly that can be used as a relatively low-cost replacement for an inefficient fixed speed motor in an existing HVAC system. The replacement blower motor assembly allows for economical continuous fan operation, and is quieter than conventional fixed speed motors.

U.S. Pat. No. 8,470,071 discloses an HVAC system that transfers sensible and/or latent energy between air streams, humidify and/or dehumidify air streams.

SUMMARY OF THE INVENTION

Embodiments of the present invention are directed to an improved, environmentally friendly and energy efficient HVAC system. Simplified and improved modifications are adapted to existing HVAC systems, as well as to new systems without the necessity for extensive electrical connections in order to complete an effective and energy efficient system. The present invention essentially replaces the common air to air method of HVAC with a compact chilled or heated solution system.

The instant invention can be incorporated into multiple new, or existing single air to air, HVAC systems within a building or group of buildings and modify them into a single air to solution system. The single air to solution system eliminates multiple air to air systems operating independently to maintain temperature throughout a building or buildings. Instead, each independent condensing unit and air handler is converted and incorporated into a single chilled solution loop system that can take advantage of the capacity to maintain temperature in an entire building or buildings. This eliminates the inefficiency of multiple single system condensing unit and air handlers operating independently. This level of consolidation allows for modulation of the system condensing units to provide chilled solution to each individual air handler and more effectively, efficiently and dynamically maintain the building space temperature. A single condensing unit can maintain the entire building comfort level in a minimum demand condition and can sequence other condensing units on and/or off as the heat load of the building increases or decreases to meet the demand and maintain temperature set points. A single digital controller dynamically controls the system for optimum performance and efficiency. This level of sequencing of the condensing units in a single chilled solution loop system has proven to be much more efficient over single air to air systems working independently.

In one embodiment, in the improved HVAC system, an existing compressor is used, but the method for cooling and heating the conditioned space is altered by using the existing compressor in a closed Refrigerant loop that extends only a short distance to a heat exchanger located outside the conditioned space and adjacent to the compressor. This provides the capacity for cooling or heating a solution within the heat exchanger with far less Refrigerant.

The solution, and not Freon or other refrigerant, is then the medium for removing heat from or adding heat to the conditioned space. The solution passes through the heat exchanger and into pump(s) which pump the solution through the closed loop to the air handler evaporator coil and back thus closing the loop. With this system, the solution is circulated much of the time and continues to transfer heat in or out while the compressor is cycled off, a clear advantage over the existing systems because the conditioned space remains at a relatively constant temperature, greatly reducing peaks and valleys in energy consumption often seen in air to air systems.

The preferred solution is a biodegradable fluid with a heat exchange rate exceeding that of water or air. Hereby going forward the word "solution" refers to Applicant's proprietary fluid. This solution is moved in a closed cooling loop at temperatures ranging from 26-50 degrees at maximum pressures of 10 to 40 pounds. This results in lower head pressures on the refrigerant loop compressor and thus lower start-up and running currents (i.e., lower energy demand at the compressor and electric meter. The lower head pressure on the compressors reduces the stress on them and therefore can extend the life of the equipment. The heating cycle can utilize high solution temperatures and thus heat in all conditions without the need for supplemental electric heat strips or other less energy efficient means of heating.

A controller acts as a dynamic modulator that uses proprietary schedules to balance the system to changing operating conditions. It is also designed to facilitate maintenance activities.

The modulator is a microprocessor which provides a host of functions which address the comfort level, how the equipment is utilized, and the proprietary protocol for insuring efficient operations. These functions include controls, monitoring, operation, parameters, data collection, communications, and system protection. Operating parameters are programmed into the processor and thus provide the instantaneous controlling necessary for achieving both the desired comfort level and the operating efficiencies customers' desire. Operating data is captured, stored, and/or communicated to interested parties via BACnet protocol, Modbus technology, and the internet, a feature rarely seen on small to medium conventional systems and prepares the user for HVAC demands of the future.

Accordingly, the improved HVAC system utilizes less refrigerant and requires less energy demand (Kwd). Furthermore, this improved system extinguishes the need for the presence of the refrigerant and refrigerant lines in the air handler as the heated/cooled solution sufficiently adjusts the air temperature to the desired level.

Accordingly, it is an objective of the instant invention to enable the use of a proven technology to make existing HVAC systems more efficient.

It is a further objective of the instant invention to provide an HVAC system with a lower electrical demand.

It is yet another objective of the instant invention to reduce the volume of refrigerants used, such as Freon, in HVAC systems.

It is a still further objective of the invention to eliminate the use of refrigerants in HVAC systems from within the enclosed conditioned space wherein a first closed loop can take place in a small area to minimize the amount of refrigerant and refrigerant piping required in the system and eliminate the need to pump the refrigerant into the enclosed space.

It is yet a further objective of the invention to eliminate or negate the need to use supplemental heat strips from HVAC systems by providing a system that converts a solution loop from a cooling mode to heating mode.

Other objectives, advantages and benefits of this invention will become apparent from the following description taken in conjunction with any accompanying drawings wherein are set forth, by way of illustration and example, certain embodiments of this invention. Benefits of the system include: 1) It dramatically lowers the electrical demand and provides a much improved load factor associated with the electric utility; 2) It saves the utility customer cost and the electrical utility company the requirement to provide a higher level of demand infrastructure; 3) Eliminates the refrigerant and refrigerant piping from the occupied spaces (All the refrigerant resides outside of the building); 4) Eliminates up to 60% of the refrigerant of a typical system; 5) Improved comfort control; 6) Quick temperature recovery; 7) Lower installation cost; 8) Lowers electrical generating plant emissions and our carbon footprint; 9) Reduced maintenance on the equipment; and 10) Extends the life of the condensing units due to lower operating pressures. Any drawings contained herein constitute a part of this specification and include exemplary embodiments of the present invention and illustrate various objects and features thereof.

BRIEF DESCRIPTION OF THE FIGURES

Embodiments of the invention are described by way of example with reference to the accompanying drawings in which.

DETAILED DESCRIPTION OF THE INVENTION

Figure 1:
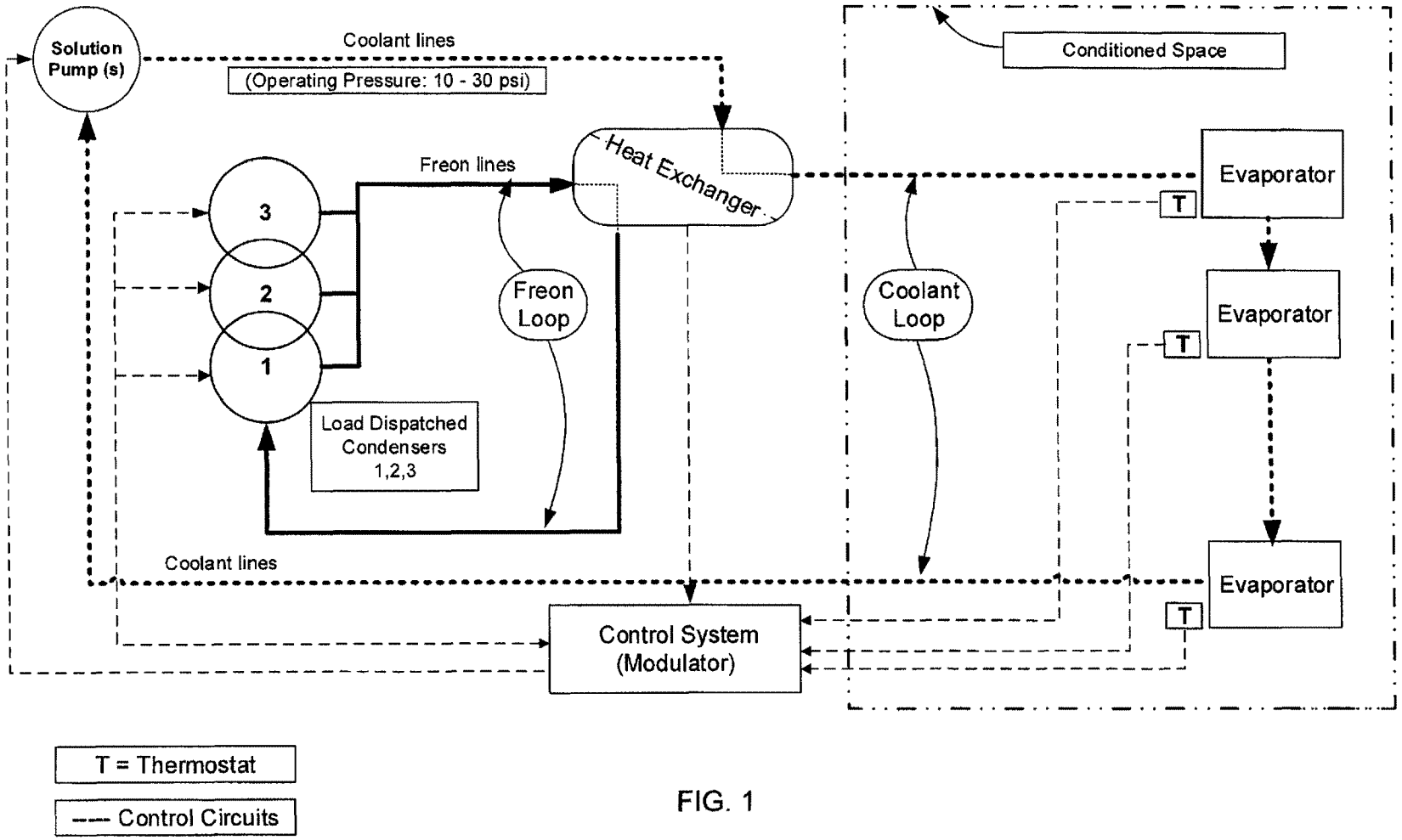
FIG. 1 is a high level schematic of the instant invention.
Figure 2:
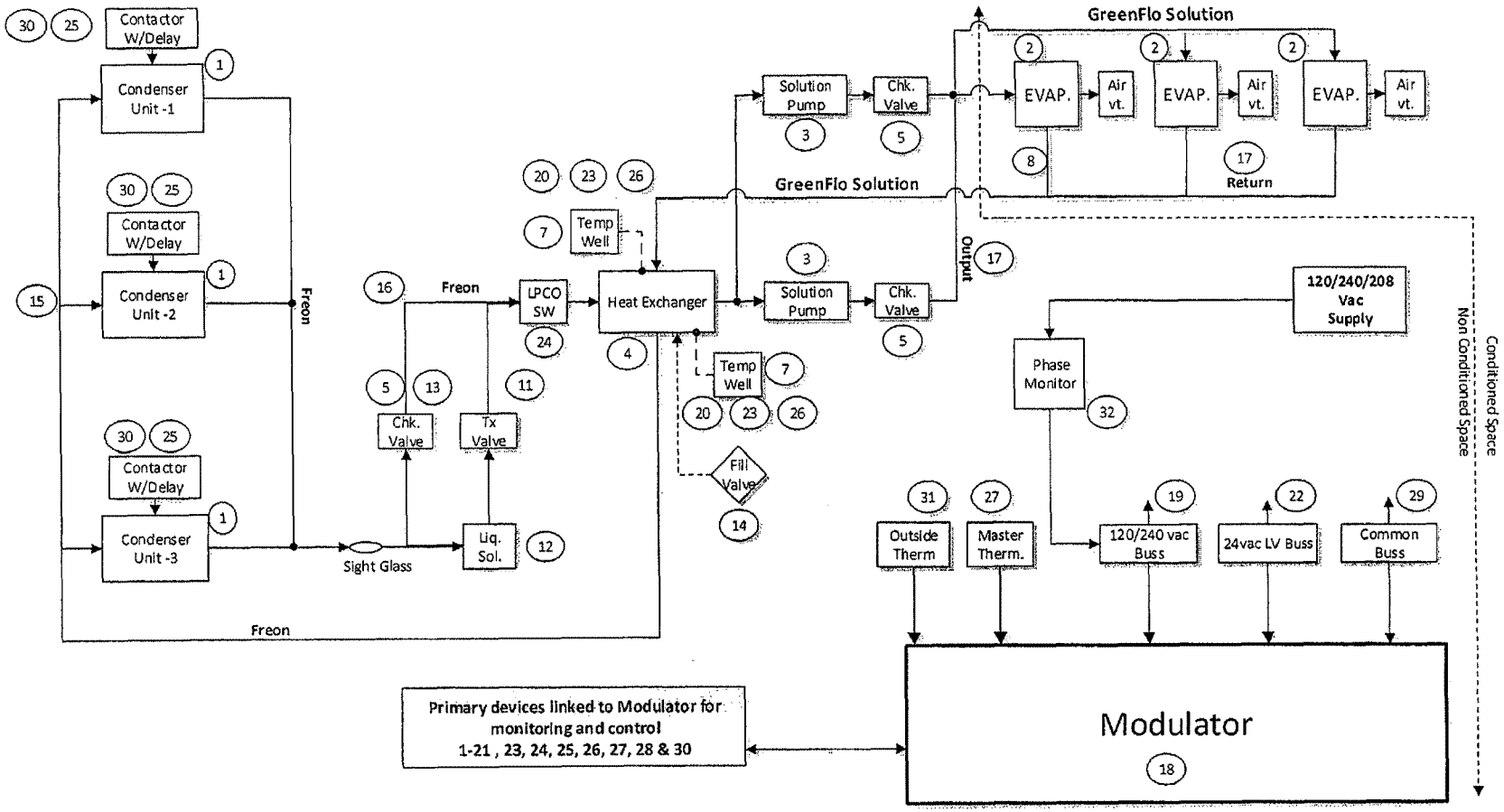
FIG. 2 is a detailed schematic view of FIG. 1.

The present invention will now be described more fully with reference to the accompanying drawings in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Before the present systems and methods are described, it is to be understood that this invention is not limited to the particular system, manufacture, processes or methodologies described, as these may vary. It is also to be understood that the terminology used in the description is for the purpose of describing the particular versions or embodiments only, and is not intended to limit the scope of the present invention. Unless defined otherwise, all technical terms used herein have the same meanings as commonly understood by one of ordinary skill in the art. Although any methods and materials similar or equivalent to those described herein can be used in the manufacture, practice or testing of embodiments of the present invention, the preferred apparatus, systems, methods, and devices are now described.

It must also be noted that as used herein and in the appended claims, the Singular forms "a", "an", and "the" include plural reference unless the context clearly dictates otherwise.

Typical HVAC systems used in automotive, residential, commercial and industrial settings include the following components and their definitions:

"HVAC system" is a heating, ventilation, and air conditioning system for indoor and automotive environmental comfort which allows for control and adjustment of temperature inside a building, ship or vehicle.

A "thermostat" is a temperature-sensitive switch used to turn the HVAC system on and off, usually installed in a central location in the building to respond to the air temperature of a room or area. This switch can be operated manually or be pre-set to switch on or off at a specific ambient room temperature, activating either the heating or cooling function in the HVAC system. The thermostat is wired to the control mechanism of an HVAC system or furnace.

An "air handler" is a control center for a HVAC system, and is typically installed as part of a furnace assembly in a dedicated indoor space, basement or attic or an outdoor package unit. The air handler's basic function is to provide heated or cooled air to a system of ducts or airways that carry the treated air through the building, where it is vented into various rooms or spaces. These two functions are handled within the air handler by the heat exchanger and the evaporative coil.

A "chiller" or "heat exchanger" is a device that removes or adds heat from a solution via a vapor-compression or absorption refrigeration cycle. This cooled refrigerant typically flows through pipes in a building and passes through coils in air handlers, fan-coil units, or other systems, cooling and usually dehumidifying the air in the building.

A "condensing unit" of the HVAC system is typically located outside of the building and houses a compressor that condenses refrigerant gas, cooled by heat exchange with the outside air, to a fluid, then pumps the fluid through a metal line to the evaporator coil in the furnace unit. As it passes through a restriction device such as a capillary tube or an expansion valve, which lowers the pressure and the fluid evaporates back into a gas as it passes through the evaporator coil. In this process, the evaporation absorbs adjacent heat, the air cools, and blowers force the refrigerated air through the duct system, which distributes it to the interior spaces of the building. The refrigerant, returned to a gas, is then returned to the condensing unit to repeat the cycle.

"Refrigerant Lines" are generally copper or aluminum tubing lines that carry liquefied refrigerant from the condensing unit to the evaporator coil and then recycle the vaporized refrigerant back.

Split HVAC systems have two main components: a condenser unit, which cools refrigerant, and an indoor air handler, which turns the refrigerant into cold air. In packaged air conditioning units, the condenser, cooling coil, and air handler are combined into one unit. The simplest example of a packaged unit is a window air conditioner, which performs all the • functions necessary to cool air in one fairly small unit. Packaged HVAC systems are predominantly used in commercial buildings whereas split HVAC systems are mainly used in residential buildings.

Embodiments of the present invention are directed to an improved, environmentally friendly and energy efficient HVAC system. Simplified and improved modifications are adapted to existing HVAC systems, as well as to new systems without the necessity for extensive electrical connections in order to complete an effective and energy efficient system.

Referring to the figures generally, the preferred embodiment of the invention is an improved HVAC system for saving energy and refrigerant in a residential, commercial, industrial, automotive, ships, or other HVAC setting. The commercial HVAC system comprises at least one condensing unit 1, a heat exchanger 4, a solution pump 3, refrigerant lines 15 and 16, solution lines 17, a control module 18, and air handler and evaporator coil 2. In the first closed loop, refrigerant lines 15 and 16 containing refrigerant arrive at the condensing unit 1 compressor as a cool, low-pressure gas (not shown) where refrigerant molecules are compressed together. The refrigerant leaves the condensing unit 1 compressor as a hot, high pressure gas and flows into the condensing unit coil where the condenser fan blows outdoor air across the coil and transfers heat from the refrigerant to the air and the refrigerant condenses to a liquid. The liquid then travels through a refrigerant line 16 to the solenoid valve 12. The liquid refrigerant then flows through the thermostatic expansion valve 11 and enters into the heat exchanger 4 where the liquid refrigerant's pressure drops and it begins to evaporate (not shown). As the liquid refrigerant changes to gas and evaporates, it extracts heat from the cooling solution (moving forward will be referred to only as solution) surrounding it, making the cooling solution cold. By the time the refrigerant leaves the heat exchanger 4, it has returned to a cool, low pressure gas. The refrigerant returns from the heat exchanger 4 to the condensing unit 1 compressor to begin this cycle again. The first closed loop can all take place in a small area to minimize the amount of refrigerant and refrigerant piping required in the system, and eliminate the need to pump the refrigerant into the enclosed space, or building.

In a second closed loop, a solution is used which takes a lot less time to cool than a typical refrigerant gas, such as Freon. The solution can be water but the proprietary solution is preferred as it has the ability to exchange heat over a broader range of temperatures without freezing. A solution pump 3, pumps the solution through the solution pipes 17 into the heat exchanger 4. As the refrigerant evaporates as it flows through the heat exchanger, it removes heat from the solution. The solution gets colder a lot faster than the refrigerant in a conventional air to air system. The solution can transfer more heat from air in a coil because the solution is in full contact of the piping in the coil vs. evaporating refrigerant as it passes through a coil. Note that isolation valves (not shown) can be installed throughout the system to allow for isolating components for ease of maintenance or replacement and allow the system to continue to operate in the non-affected areas. The preferred solution is a proprietary biodegradable fluid with a heat exchange rate exceeding that of water or air. This solution moved in a closed cooling loop at temperatures ranging from 26-50 degrees at maximum pressures of 10 to 40 pounds per square inch. This results in lower head pressures on the refrigerant compressor (in the outside loop) and thus lower start-up and running currents (i.e., lower energy demand at the compressor and electric meter). A liquid line solenoid valve (not shown) is incorporated into each individual condensing unit and is controlled to allow for a pump down process as the system cycles each condensing unit off. As the digital controller cycles each condensing unit on the solenoid valve opens and allows the refrigerant to flow into the heat exchanger before the compressor is started. The refrigerant cools in the heat exchanger and this lowers the pressure that the compressor has to start against therefore lowering the initial startup current draw. The compressor is started when the digital controller determines the lowest pressure for optimization of lowest possible start up current.

Furthermore, the chilled solution maintains its temperature for a longer period of time in comparison to a refrigerant and therefore allows for conserving energy, since it takes less time (and therefore less energy) to get to the desired temperature. The solution pipes 17 are then extended from the heat exchanger 4 to the air handler evaporator coils 2, where the chilled solution can regulate the air temperature within the conditioned space of the building. One of the key feature of this improvement is that the refrigerant lines 15 and 16 no longer enter the building or the air handlers 2 to adjust air temperature. This removes the hazards associated with refrigerant leaks inside the occupied spaces. Instead, a proprietary non hazardous chilled solution enters the air handler 2 evaporator coils and adjusts the air temperature to the desired level (not shown) by heat transfer between the air and the proprietary solution. As the air moves through the air handler 2 and the coil, heat is removed from the air at a higher rate than a conventional refrigeration air to air system. (Conventional air to air systems typically can only maintain indoor air temperature of 20 degrees below what the outdoor ambient air temperature is. This system can maintain 30+ degrees below the outdoor ambient air temperature.) At a solution temperature set point, the air coming off the air handler 2 coil is 50 to 55 degrees depending on the heat load in the building. Once the temperature of the air reaches 50 to 55 degrees, it is blown through the air ducts inside the building. The solution pump 3 then pumps the solution back from the air handler 2 evaporator coils and back into the heat exchanger 4. This second closed loop is where the building occupied space air temperature is changed. The controller 18 regulates and controls the processes of both the first and second closed loops to maximize efficiency and energy savings. The controller can monitor ambient outdoor air temperature, solution temperature, indoor temperature and other factors that allow the controller to turn the solution pump on and off when heating or cooling are not needed conditions are optimum allowing for more energy efficiency and energy conservation. A phase monitor can be installed with the system to protect vital components. This improved, energy-conserving HVAC system reduces the amount of refrigerant by up to 60% and therefore has a tremendous positive economic and environmental impact.

In a further embodiment, the HVAC system additionally includes a bypass 5 which encompasses a check valve 13 and pipe that allows for reversing the flow of the refrigerant around the solenoid valve 12, and a thermal expansion (Tx) valve 11 in order to control and regulate the refrigerant flow in a reversed cycle or heat pump mode. Thus converting the solution loop from cooling mode to heating mode. In heat mode the solution is heated to a temperature of 80 to 90 degrees controlled by the DDC controller 18. This allows for a higher level of efficiency of heating the building and eliminates the need for supplemental electric heat strips. The solenoid valve 12 in the heat mode is de-energized therefore closed. The hot refrigerant gas from the heat pump condensing unit flows through the refrigerant suction line 15 and into the heat exchanger 4 and heat is transferred from the hot gas to the solution. As the heat is transferred to the solution the hot gas condenses back to a liquid state and then flows back to the condensing unit 1 through the refrigerant liquid line 16 and the bypass check valve 13. The bypass check valve 13 allows the liquid refrigerant to flow back to the heat pump condenser 1, thus completing the refrigerant cycle and repeats until the temperature of the solution has reached its set point. The solution pump 3 pushes the hot solution through the solution lines 17 to the heat exchanger 4 and then to the air handler 2 which blows the air through the coil and heats the air which is then distributed through the air ducts throughout the interior of the building. When the thermostat controlling the air handler 2 is satisfied it shuts the fan off in the air handler 2.

The air vents are used only to purge air out of the loop upon initial setup and then closed once the system is fully charged. The solution loop then becomes a truly closed loop with no requirement for an automatic make up water supply. One key feature of the instant invention is that the refrigerant lines 15 and 16 no longer enter the building and its air handlers 2 to adjust the air temperature. Instead, chilled or heated solution enters the building and its air handlers 2 through solution lines 17 and adjusts the air temperature to the desired level (not shown). In the air handler 2, once the temperature of the air reaches the desired level, it is blown through the air ducts to the inside of the building. Removing the refrigerant loop from the occupied space further removes the hazards associated with occupant exposure had refrigerant been present and leaking.

In another embodiment, where Natural Gas is available and preferred by the customer, a gas fired hot water heater can be incorporated into the solution loop to heat the solution loop in lieu of a heat pump condensing unit. Natural gas fired heat further reduces the electric demand and is a more energy efficient, sustainable and cost effective means of heating. Solar heat could also be incorporated into the solution loop in order to take advantage of more energy savings and conservation.

Further, the applicant discloses a method of improving an HVAC system comprising the steps of: forming a first closed loop having a first pump to transfer refrigerant; directing said refrigerant from at least one compressor for phase changing said refrigerant into a high pressure gas; cooling said refrigerant gas by a heat exchanger constructed and arranged to reduce the gas pressure with evaporation and extracting heat; returning said refrigerant expelled from said heat exchanger to said pump to provide recirculation; forming a second closed loop having a second pump to transfer a solution; directing said solution to a cooling inlet of said heat exchanger, said solution capable of cooling faster and maintaining a stable temperature longer than the refrigerant and is moved at temperatures ranging from 26-50 degrees F. at a pressures less than 40 pounds; transferring said solution from an outlet of said heat exchanger to an evaporator coil positioned within an interior of a building for use in regulating the air temperature within the conditioned space of the building; and recirculation of said solution.

Case Study

Conditioned Space: 13,025 SQ. FT

Average Age of Existing Equipment: 13 Years

A. EQUIPMENT PRIOR TO RETROFIT: SIX UNITS CONSISTING OF 42.5 TONS OF AIR TO AIR CONDITIONING AND HEATING VIA HEAT PUMPS WITH SUPPLEMENTAL HEAT STRIPS.

SCHEDULE:

I. UNIT-(1) 5 TON SPLIT SYSTEM WITH 10 KW SUPPLEMENTAL ELECTRIC HEAT STRIPS. 10 SEER

II. UNIT-(2) 5 TON SPLIT SYSTEM WITH 10 KW SUPPLEMENTAL ELECTRIC HEAT STRIPS. 10 SEER

III. UNIT-(3) 7.5 TON SPLIT SYSTEM WITH 15 KW SUPPLEMENTAL ELECTRIC HEAT STRIPS. 10 SEER

IV. UNIT-(4) 5 TON SPLIT SYSTEM WITH 10 KW SUPPLEMENTAL ELECTRIC HEAT STRIPS. 14 SEER

V. UNIT-(5) 10 TON SPLIT SYSTEM WITH 20 KW SUPPLEMENTAL ELECTRIC HEAT STRIPS. 10 SEER

VI. UNIT-(6) 10 TON SPLIT SYSTEM WITH 20 KW SUPPLEMENTAL ELECTRIC HEAT STRIPS. 10 SEER

B. EXISTING CONDITIONS PRIOR TO INSTALLATION OF THE SYSTEM

1. ONE OF THE 10 TON UNITS FAILED DUE TO A REVERSING VALVE FAILURE WHICH LOCKED UP THE COMPRESSOR DUE TO EXTREMELY HIGH HEAD PRESSURE.
2. THE EXISTING EQUIPMENT COULD NOT ADEQUATELY COOL THE BUILDING.
3. THE ENTIRE SYSTEM NEEDED REPLACEMENT DUE TO REGULATORY REQUIREMENTS CALLING FOR THE USE OF AN R-410A SYSTEM INSTEAD OF THE EXISTING R-22 SYSTEM.

C. SYSTEM INSTALL AND RETROFIT JULY 2011

1. IT WAS DETERMINED THAT WITH THE IMPLEMENTATION OF THE INSTANT INVENTION COULD ELIMINATE THE FAILED 10 TON SYSTEM BUT AN ADDITIONAL 10 TONS COULD ALSO BE REMOVED.
2. REMOVED 2 OF THE 5 TON UNITS.
3. A TOTAL OF 20 TONS OF COOLING CAPACITY WAS REMOVED.
4. THE REMAINING 22.5 TONS OF HVAC SYSTEMS WAS RETROFITTED WITH THE INSTANT INVENTION

D. POST INSTALLATION

Figure 3:
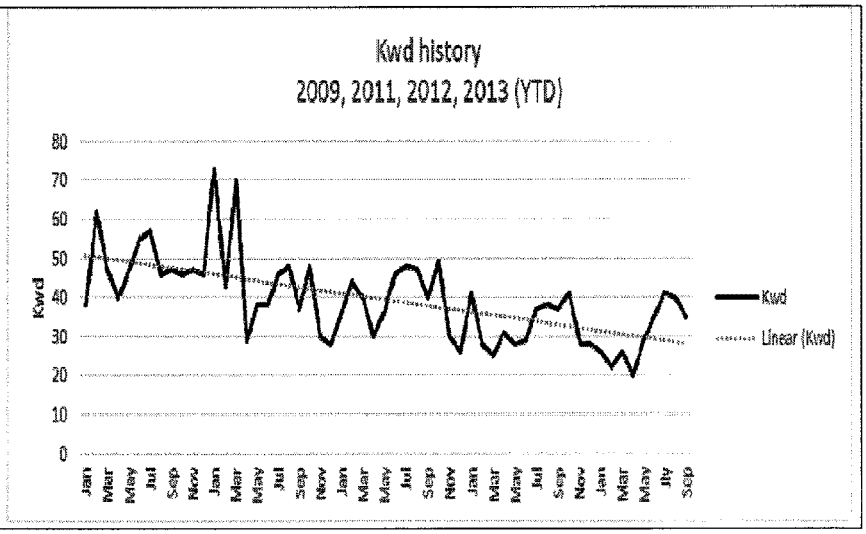
FIG. 3 is a graph of case findings regarding electrical demand.
Figure 4:
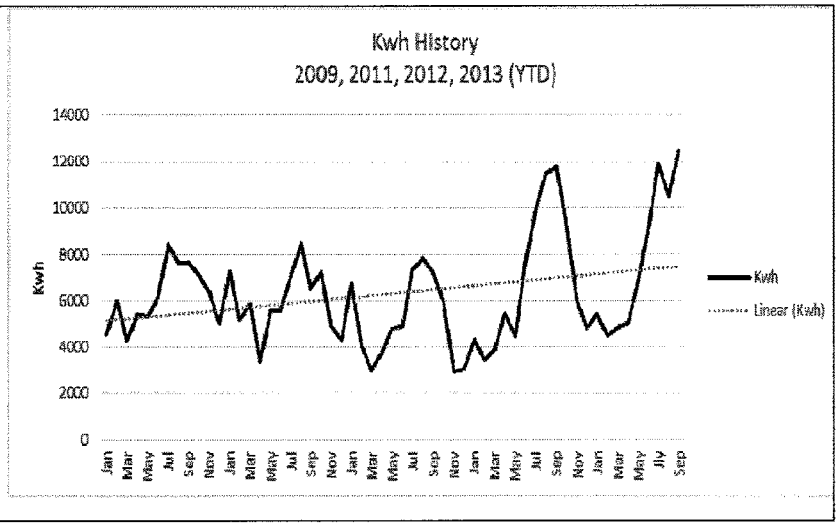
FIG. 4 is a graph of case findings regarding electrical consumption.
Figure 5:
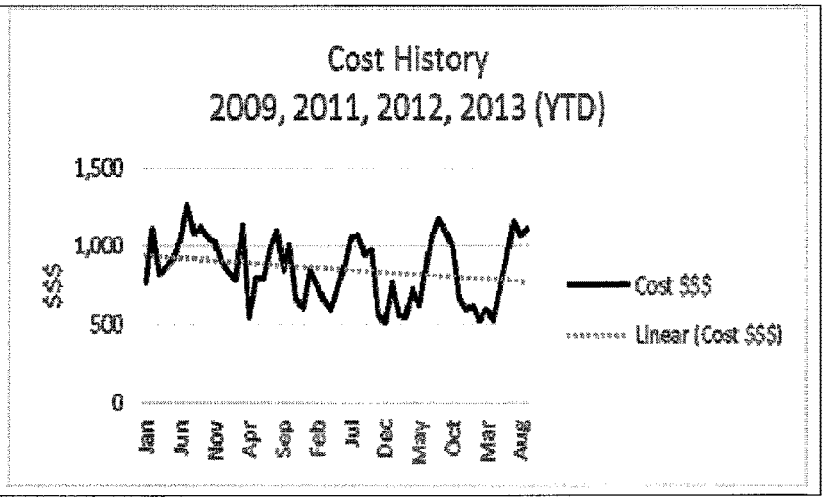
FIG. 5 is a graph of case findings regarding cost history.

1. AFTER THE SYSTEM WAS INSTALLED, THE TEMPERATURE IN THE BUILDING WAS MAINTAINED AT 70 DEGREE SET POINT. THE BUILDING OCCUPANTS WERE VERY SATISFIED WITH THE CONDITIONS AND EVEN TEMPERATURES THROUGHOUT THE BUILDING.
2. THE OWNER REALIZED A 37.5% REDUCTION IN THE Kwd DEMAND CHARGE ON THE ELECTRIC BILL.
3. AS A RESULT OF MAINTAINING A HIGHER COMFORT LEVEL IN THE BUILDING, THE UTILIZATION INCREASED THUS RESULTING IN HIGHER KWH. THE OVERALL ELECTRIC COST CONTINUED TO BE SIGNIFICANTLY LOWER THAN WITH THE PRIOR SYSTEM. See FIGS. 3, 4 and 5.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An improved HVAC system comprising:

a first closed loop positioned outside a building interior for recirculation of a refrigerant gas positioned in a non-conditioned space wherein refrigerant gas does not enter said building interior, said first closed loop consisting of at least one compressor having an inlet for receipt of low-pressure refrigerant gas and an outlet for directing high pressure refrigerant gas through at least one condenser, said condenser includes a fan for passing ambient air across said condenser for dispensing heat contained in said refrigerant gas, said condenser converting high pressure refrigerant gas to liquid refrigerant;

a chiller having a thermostatic expansion valve dissipating refrigerant pressure, said chiller constructed and arranged to reduce the refrigerant pressure causing evaporation as heat is extracted, said refrigerant liquid is expelled from said chiller and fluidly coupled to said compressor for recirculation;

a second closed loop having a solution pump fluidly coupled to a cooling inlet of said chiller, said cooling inlet receiving a biodegradable solution consisting of properties capable of cooling faster and maintaining a stable temperature longer when recirculated at temperatures ranging from 26-50 degrees at pressures of 10-40 pounds per square inch wherein said compressor can operated with reduced head pressures which allows for lower start-up and running currents; and an evaporator coil positioned within an interior of a building for receipt of said solution from said chiller for use in regulating the air temperature within the interior of the building, said solution returned to said solution pump to provide recirculation to said cooling inlet of said chiller;

whereby said solution pump can continue to recirculate solution when said compressor is cycled off allowing temperatures in said building interior to remain relatively constant.

2. The improved HVAC system according to claim 1 including a control module to regulate said solution pump and said compressor.

3. The improved HVAC system according to claim 1 wherein said solution is formulated with a heat exchange rate exceeding that of water or air, wherein said evaporator coil conditions air between 50-55 degrees F.

4. The improved HVAC system according to claim 1 wherein said chiller functions as a heat exchanger wherein said solution is heated providing a heating cycle without the necessity of supplemental electric heat strips.

5. A method of improving an HVAC system comprising the steps of:

forming a first closed loop to transfer refrigerant gas in a non-conditioned space wherein said refrigerant gas does not enter an interior of a building;

directing said refrigerant gas through a compressor for phase changing said refrigerant gas into a high pressure refrigerant gas;

passing said high pressure refrigerant gas through a condenser to dispense heat;

cooling said refrigerant gas by a chiller constructed and arranged to reduce the gas pressure with evaporation and extracting heat;

returning said refrigerant expelled from said chiller to provide recirculation through said compressor;

forming a second closed loop in an interior of a building having including a solution pump to transfer a solution;

directing said solution to a cooling inlet of said chiller, said solution capable of cooling faster and maintaining a stable temperature longer than the refrigerant and is moved at temperatures ranging from 26-50 degrees F. at a pressures less than 40 pounds per square inch;

transferring said solution from an outlet of said chiller to an evaporator coil positioned within an interior of a building for use in regulating the air temperature within the conditioned space of the building; and recirculation of said solution through said second closed loop when said compressor is cycled allowing temperatures in said building interior to remain relatively constant.

6. The method of improving an HVAC system according to claim 5 including the step of heating said solution wherein said HVAC system operates as a heater.

7. The method of improving an HVAC system according to claim 6 wherein said solution and said step of heating is constructed and arranged to eliminate the need for electric heat strips.

* * * * *